US005586441A

United States Patent [19]

Wilson et al.

[11] Patent Number: 5,586,441

[45] Date of Patent: Dec. 24, 1996

[54] HEAT PIPE DEFROST OF EVAPORATOR DRAIN

[75] Inventors: Wilbert J. Wilson, Fullerton, Calif.; Robert G. O'Neal, Yuma, Ariz.

[73] Assignee: Russell A Division Of Ardco, Inc., Brea, Calif.

[21] Appl. No.: 438,169

[22] Filed: May 9, 1995

[51] Int. Cl.[6] ..... F25D 17/02

[52] U.S. Cl. ..... 62/99; 62/275; 62/285; 62/80; 165/104.21

[58] Field of Search ..... 62/272, 275, 278, 62/282, 285, 80, 81, 82, 98, 99; 165/104.21

[56] References Cited

U.S. PATENT DOCUMENTS 3,451,226 6/1969 Shirver ..... 62/277

5,315,836 5/1994 Ressler ..... 62/277

*Primary Examiner*—John M. Sollecito

*Attorney, Agent, or Firm*—Knobbe, Martens, Olson & Bear

[57] ABSTRACT

A sealed, closed end heat pipe efficiently warms the drain for an evaporator so that condensation may flow unobstructed away from the evaporator in the refrigeration circuit. An evaporator end of the heat pipe is exposed to ambient air and a condenser end is located close to the drain inlet adjacent the evaporator. Thus, no external power source is required as fluid within the evaporator end is heated to vapor phase and circulates toward the condenser end, and cooled fluid from the condenser end returns to the evaporator end.

17 Claims, 4 Drawing Sheets

HEAT PIPE DEFROST OF EVAPORATOR DRAIN

BACKGROUND OF THE INVENTION

The present invention relates generally to the field of refrigeration circuits, and, in particular, to a manner of passively defrosting the drain from an evaporator.

A common refrigeration circuit is a vapor-compression system comprising a compressor, a condenser, an expansion valve, and an evaporator. A refrigerant is circulated through the circuit such that the compressor raises the pressure of the refrigerant vapor so that its saturation temperature is slightly above the temperature of an available cooling medium, such as air or water. The difference in temperature allows transfer of heat from the vapor to the cooling medium so that the vapor can condense in the condenser.

Next, the liquid expands, via the expansion valve, to a pressure such that its saturation temperature is slightly below the temperature of the space (or product) to be cooled. This temperature difference allows transfer of heat from the space to the refrigerant, causing the refrigerant to evaporate in the evaporator. The vapor formed is removed by the compressor such that the low pressure in the evaporator, and thus the refrigeration cycle, is maintained. In absorption refrigeration systems, the compressor is replaced by an absorber and generator, while retaining the condenser, flow control and evaporator.

In refrigerators, an evaporator is located in the freezer compartment and a second evaporator may be located in the cold storage compartment of the refrigerator. These evaporators are typically exposed to air in the space of the freezer and cold storage compartments. As the freezer or cold storage space is cooled, condensation forms and freezes on the exterior of the evaporator, which contains the refrigerant vapor. Periodically, a defrost cycle is initiated to melt the accumulated ice.

A drain pan or tray is usually placed below the evaporator, and has a hole for collected condensation to flow through a drain line for removal. Frost and ice formation at the tray hole and in the drain line is typical, due to the cooling of the space near the evaporator, with the result that the flow of the condensation away from the evaporator is obstructed.

One method of defrosting the drain is the use of an electric device. The use of electric coils or the like results in increased power usage and therefore higher operating costs of the refrigerator. The inclusion of the coils at the drain of the evaporator adds to the manufacturing complexity and cost of the refrigerator. Also, incorporation of the electric device into the refrigerator may reduce the amount of usable freezer or cold storage space.

Another method of defrosting the drain is by the rerouting of a heated portion of the refrigeration circuit so that a heated tube passes close to the drain as disclosed in U.S. Pat. No. 4,420,943. However, this reduces the efficiency of the refrigerator, as heat is lost from the refrigeration circuit to defrost the drain. The loading on the components of the circuit is increased, with a corresponding increase in the operating costs of the refrigerator.

The use of insulation wrapped around the drain line is inefficient for defrosting the drain, and the insulation material is subject to deterioration and loss of performance from the constant freezing conditions near the evaporator.

In view of the foregoing, a need exists for an improved evaporator drain defroster that overcomes the problems mentioned.

SUMMARY OF THE INVENTION

A simple and economical method for passively defrosting an evaporator drain overcomes the aforenoted disadvantages by including a heat pipe having a condenser end located at the evaporator drain and an evaporator or boiler end exposed to outside, ambient temperature air. Gravity facilitates circulation of a thermodynamic working fluid or heat transfer medium contained in the heat pipe, as vaporized fluid rises from the evaporator end to the condenser end of the heat pipe. Heat is released to defrost the drain, and the condensed working fluid flows down back to the evaporator end. Attachment of the heat pipe to the drain may be through conventional means, such as brazing or soldering. Thus, passive defrosting by the heat pipe is readily incorporated into a conventional refrigeration system.

Advantageously, the need for additional power resulting in increased operating costs is eliminated. Also, the efficiency of the refrigeration circuit is not affected, since none of the refrigeration components are modified.

Further advantages and applications will become apparent to those skilled in the art from the following detailed description and the drawings referenced herein.

DETAILED DESCRIPTION OF THE PREFERRED EMBODIMENTS

Figure 1:
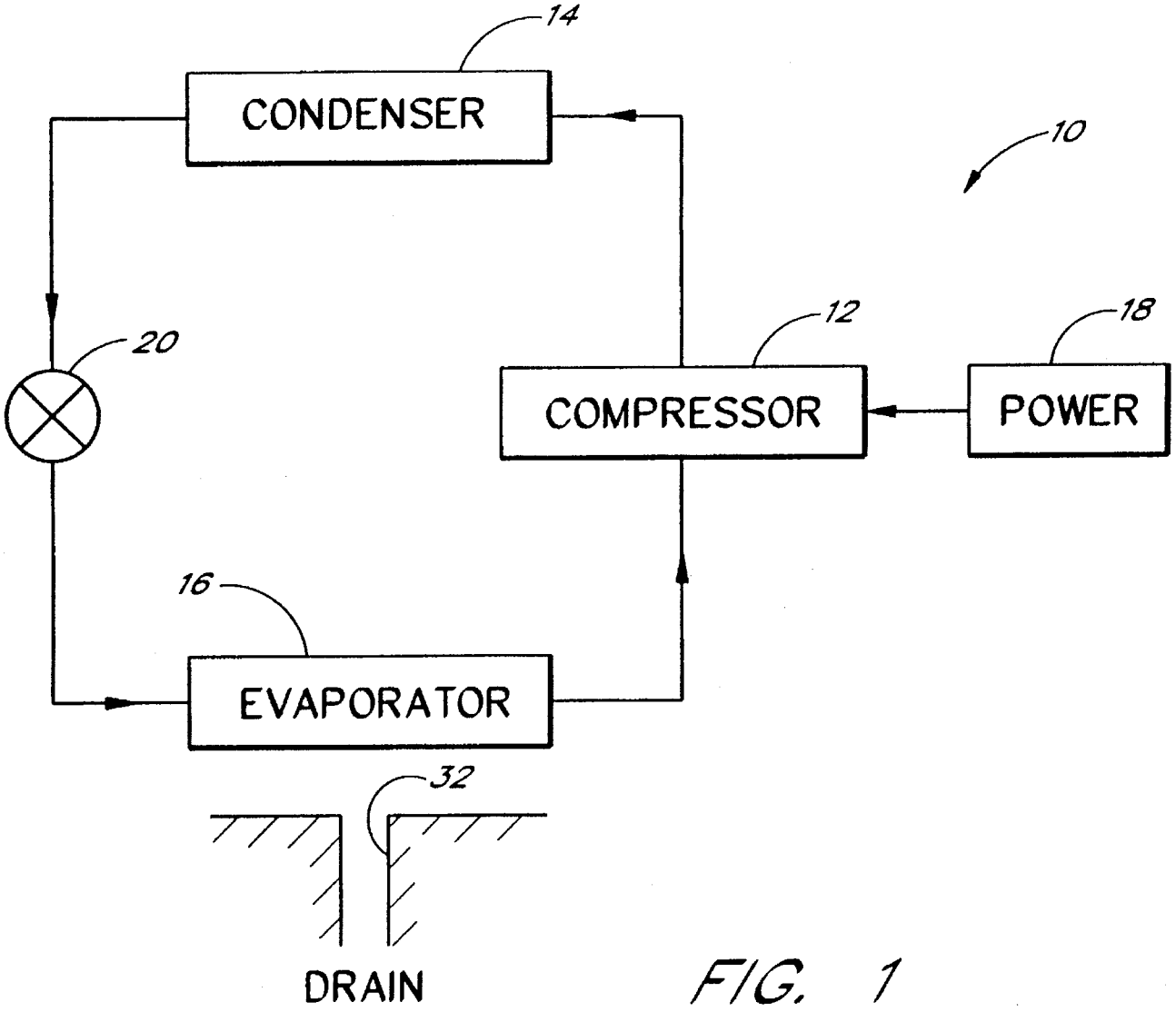
FIG. 1 is a diagram illustrating a vapor-compression cycle for a refrigeration circuit and the use of a drain at the evaporator.

A vapor-compression system of a refrigeration circuit 10 illustrated in FIG. 1 includes a compressor 12, a condenser 14, and an evaporator 16 located in at least the freezer and sometimes additionally in the cold storage compartment of a refrigerator.

The passive defrost of the present invention is also applicable to a gas or electric absorption refrigeration system utilizing an absorber and generator (not shown) in place of the compressor of the vapor-compression system 10. Both the generator and compressor 12 require a power supply 18. And, operationally, both types of systems generate a higher pressure refrigerant vapor of the circuit with a saturation temperature slightly above the temperature of the cooling medium, such as air. This difference in temperature allows the transfer of heat from the vapor to the air, so that the vapor condenses to liquid form in the condenser 14.

A capillary tube or expansion valve 20 is typically used for flow control to lower the pressure of the refrigerant such that its saturation temperature is slightly below the temperature of the freezer or storage space to be cooled. This temperature difference allows the transfer of heat from the space to the refrigerant, causing the refrigerant to evaporate in the evaporator 16 and completing the refrigeration circuit.

Figure 3:
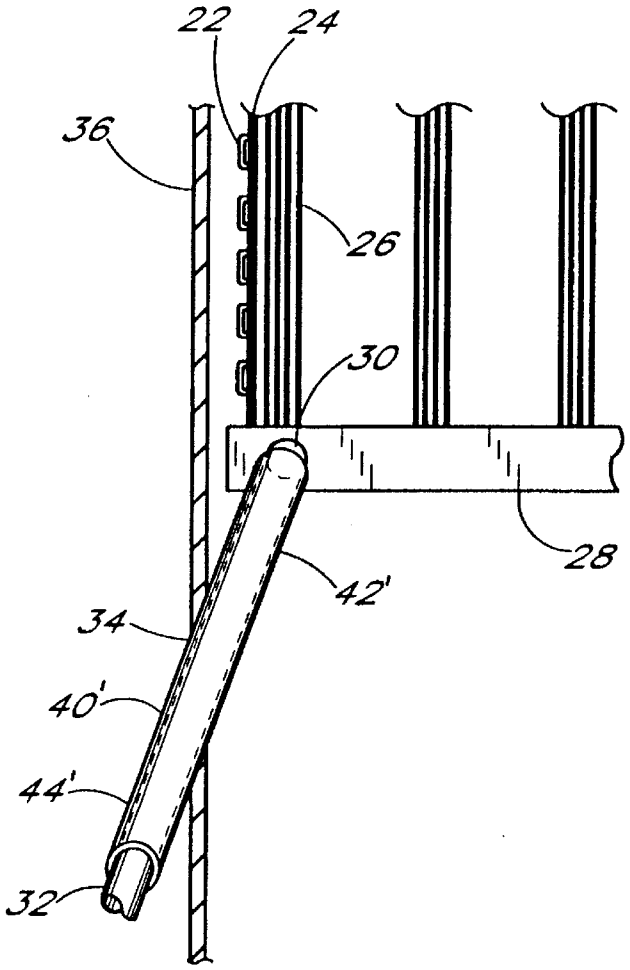
FIG. 3 is a schematic view of a second embodiment of the heat pipe defroster of the present invention, illustrating the heat pipe surrounding the drain line from an evaporator.
Figure 2:
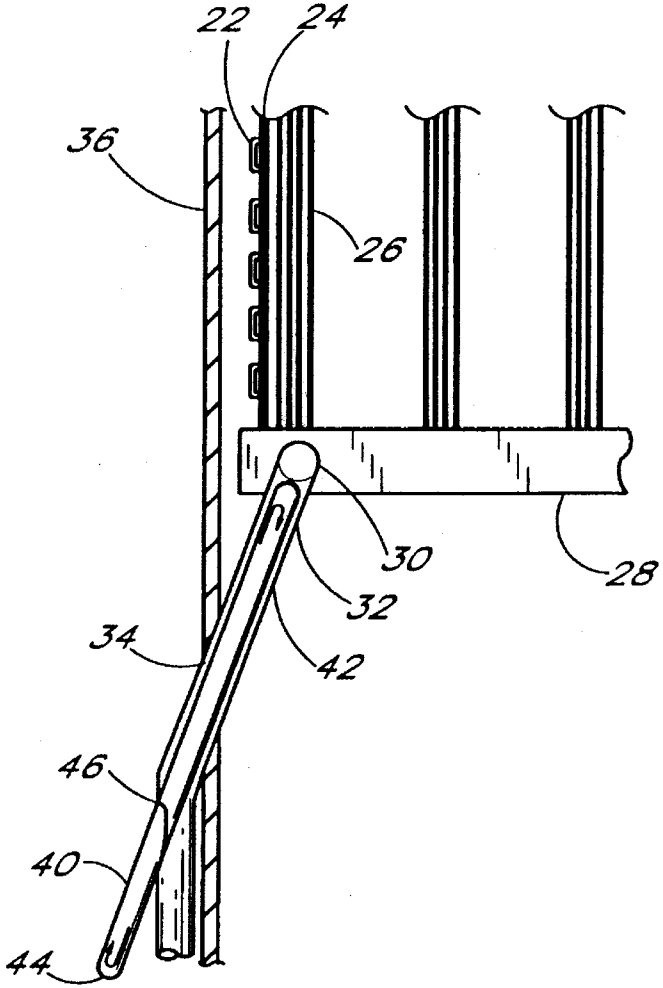
FIG. 2 is a schematic view of a first embodiment of the heat pipe defroster of the present invention, illustrating the heat pipe's insertion into the drain line from an evaporator.

The space near the evaporator 16, as well as the exterior of the evaporator 16, becomes quite cold as heat is transferred from the cooled space to the refrigerant. The evaporator 16 is typically comprised of a plurality of interconnected heat exchange tubes 22 supported by a plurality of plates 24 and fins 26 extending perpendicular to the tubes 22, as illustrated in FIGS. 2 and 3. Frost often forms over the evaporator 16, and condensation from air cooled in the space collects in a drain tray 28 below the evaporator 16. The drain tray 28 includes an outlet 30 for the collected water to flow into a drain line 32 for removal from the refrigerator.

Generally, a heat pipe is a sealed conduit containing a thermodynamic working fluid or heat transfer medium with a known vaporization temperature. The heat pipe 40 in FIG. 2 and 80' in FIG. 3 has a length much greater than its thickness or width, or diameter if it is pipe-shaped. The heat pipe has a fixed volume, and the amount of working liquid is less than this volume. The heat pipe should be sufficiently long to obtain the desired vaporizing and condensing cycle.

Exposure of the heat pipe fluid to a temperature above this vaporization temperature causes the resulting vapor to circulate to an upper, interior portion of the heat pipe. If the upper end is then exposed to a lower temperature, condensation of the working fluid results. If the pipe is tilted, gravity affects the circulation of the vapor portion of the working fluid to the upper end of the pipe, while the liquid portion of the working fluid flows to a lower end.

In a heat pipe defroster of the present invention, an upper end may be referred to as a condenser end, and a lower end may be referred to as an evaporator, generator, or boiler end. The heat pipe is preferably constructed of copper; although, other good heat conductive materials may be utilized as well. The preferred working fluid is a refrigerant, such as R22, or whatever refrigerant is being used in the evaporator 16.

As illustrated in the two embodiments of FIGS. 2 and 3, the condenser end 42, 42' of the heat pipe 40, 40' is positioned near the outlet 30 of the drain tray 28, and the evaporator end 44, 44' is positioned through a hole 34 to the outside of a back panel 36 of the refrigerator. Thus, as the ambient air behind the refrigerator heats the working fluid in the evaporator end 44, 44', the working vapor circulates up along the drain line 32 of the evaporator 16, warming it. The cold space near the evaporator 16 cools the fluid in the condenser end 42, 42' of the heat pipe 40, 40'. The working fluid is never exposed to temperatures below its freezing temperature, and therefore there are no concerns of freezing within the heat pipe 40, 40'. In alternate embodiments, a heat source other than ambient air may be utilized to warm the evaporator end 44, 44'.

The embodiment of FIG. 2 illustrates attachment of the heat pipe 40 within the drain line 32. This attachment may be accomplished by inserting the heat pipe 40 through an aperture 46 in the drain line 32 and soldering the heat pipe 40 to the line 32, such that the aperture 46 is closed. Thus, the condenser end 42 of the heat pipe 40 is contained in the drain line 32, while the evaporator end 44 is external to the drain line 32. The arrows in FIG. 2 illustrate the circulation of the working fluid in the pipe 40. Alternate attachment methods known to those skilled in the art may also be utilized in the present invention, wherein flow of the condensation around the enclosed portion of the heat pipe 40 and down through the drain line 32 is generally unobstructed.

FIG. 3 illustrates a second embodiment of the heat pipe defroster of the present invention, wherein the heat pipe 40' comprises a sleeve surrounding the drain line 32 of the evaporator 16. The sleeve has an interior wall spaced from an exterior wall of the drain line 32 to define an annular space. The ends of the annular space are closed, thus creating an elongated, annular, closed chamber in direct contact with the drain line 32 for good heat transfer. In alternate embodiments the heat pipe 40' may be a semicircular sleeve or cuff only partially surrounding the drain line 32, or may be a closed tube coupled tangentially along its length to the outside of the drain line 32. The heat pipe 40' in this embodiment is attached to the outside of the drain line 32 by clamps, soldering or other known techniques, as long as direct contact is maintained with at least a portion of the exterior of the drain line 32.

In both embodiments of FIGS. 2 and 3 of the heat pipe evaporator defroster of the present invention, both the heat pipe 40, 40' and drain line 32 are preferably installed to be at an angle with the horizon. That is, the heat pipe 40, 40' is not parallel with the horizon, such that gravity is utilized to promote circulation of the vaporized working fluid in the heat pipe 40, 40' toward its condenser end 42, 42', thus defrosting the drain line 32, and also causing the condensed fluid to flow to the evaporator end.

Figure 4:
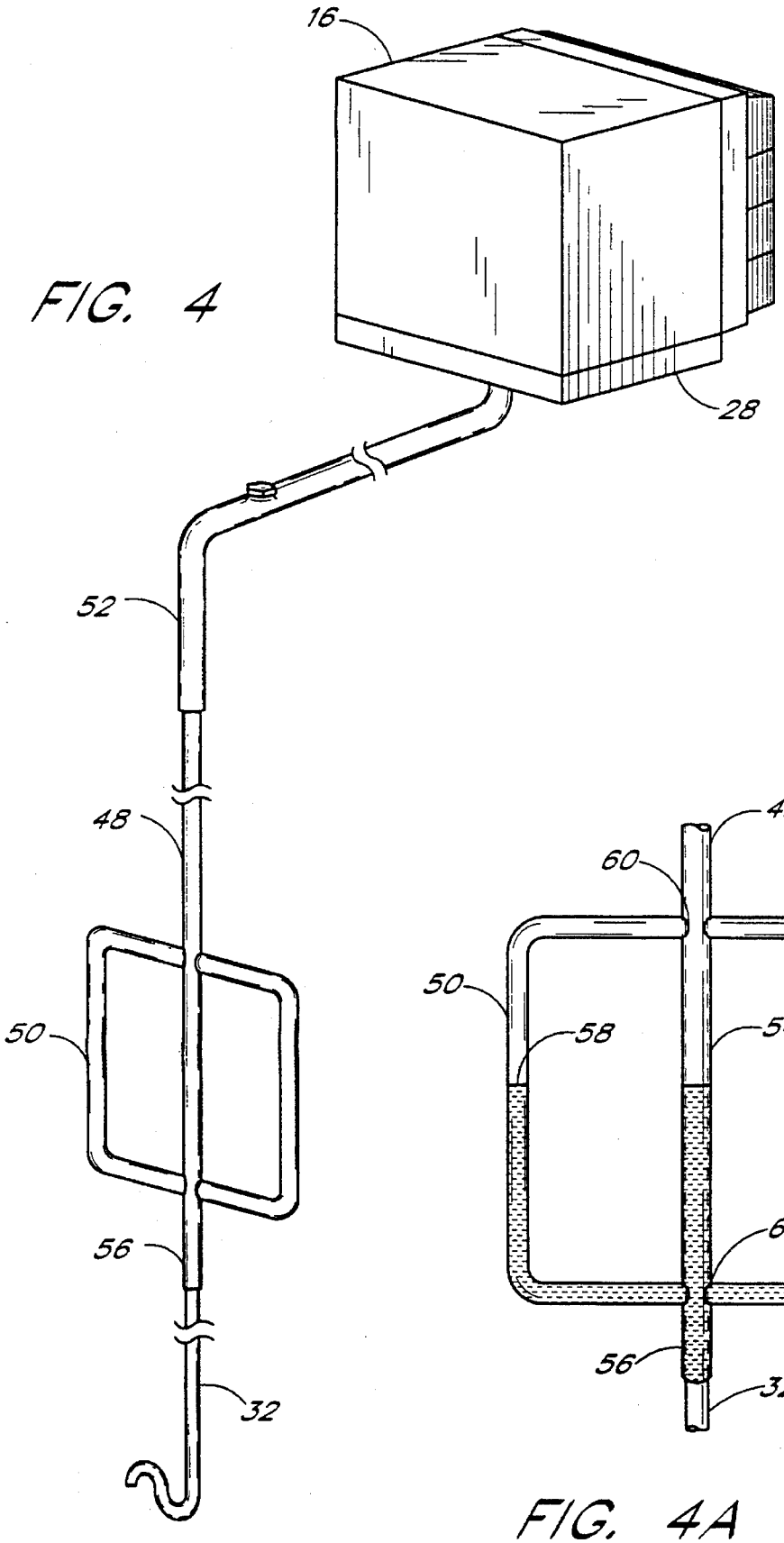
FIG. 4 is a perspective view of a third embodiment of the heat pipe defroster of the present invention, illustrating the use of a double loop portion to enlarge the amount of working fluid exposed to the warmer temperature.
Figure 4A:
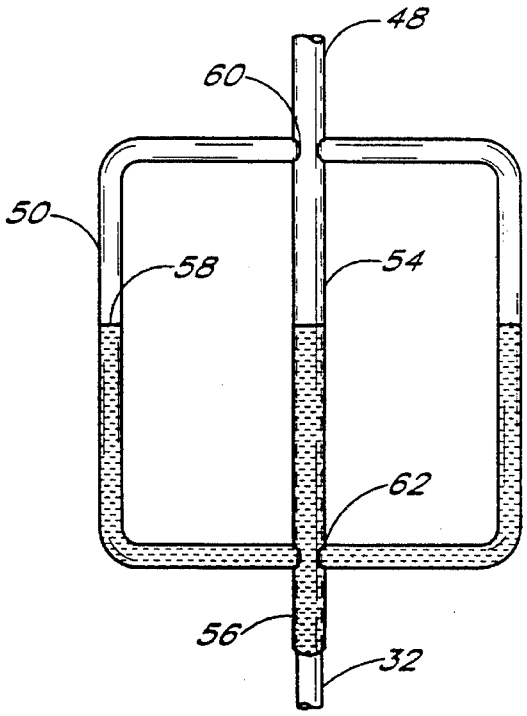
FIG. 4A is a front elevational view of the double loop of the heat pipe of FIG. 4.

The amount of heat pipe exposed to ambient air can of course be varied to provide the necessary heating of the fluid within it. An example of another arrangement for a heat pipe 48 shown in FIGS. 4 and 4A is a variation of the FIG. 3 arrangement in that the drain line 32 extends through the heat pipe 48. This arrangement illustrates the use of a double loop portion 50 to increase the volume of heat transfer fluid within the pipe as well as the amount of pipe 48 exposed to ambient air. Other shapes or arrangements may be utilized in order to provide the desired amount of heat transfer fluid and exposed, heating surface of the pipe of the present invention.

Referring to FIG. 4, the drain line 32 may be, for example, ⅝-inch copper tubing leading from the drain pan 28 of the evaporator 16. The heat pipe 48 comprises, for example, copper tubing surrounding the drain line 32 with an outer diameter of ⅞-inch, thus creating a chamber surrounding the drain line 32. The heat pipe 48 extends from near the upper end of the drain line 32, within the refrigerator, to partially down the length of the drain line 32, located outside of the refrigerator. The upper portion of the drain line 32 and the condenser end of the heat pipe 48 are preferably surrounded by suitable insulation 52 in order to minimize loss of heat from the exterior surface of the heat pipe 48 to the cold air space near the evaporator 16.

As illustrated in FIG. 4A, the loop 50 forms a square shape, with a straight section 54 of the heat pipe 48 bisecting the loop 50 and surrounding the drain line 32. The loop 50, straight section 54, and a lowermost closed end 56 comprise the evaporator end of the heat pipe 48. In this embodiment, when the fluid in the pipe 48 is cold the fluid level is at 58, approximately halfway up the loop 50 and the section 54. The loop 50 is in fluid communication with the tube straight section 54 at opening 60 at an upper junction and at a lower junction opening 62. The fluid flows around the exterior of the drain line 32 and passes through openings 60, 62 during the vaporization and condensation cycle of the heat pipe 48.

Figure 5:
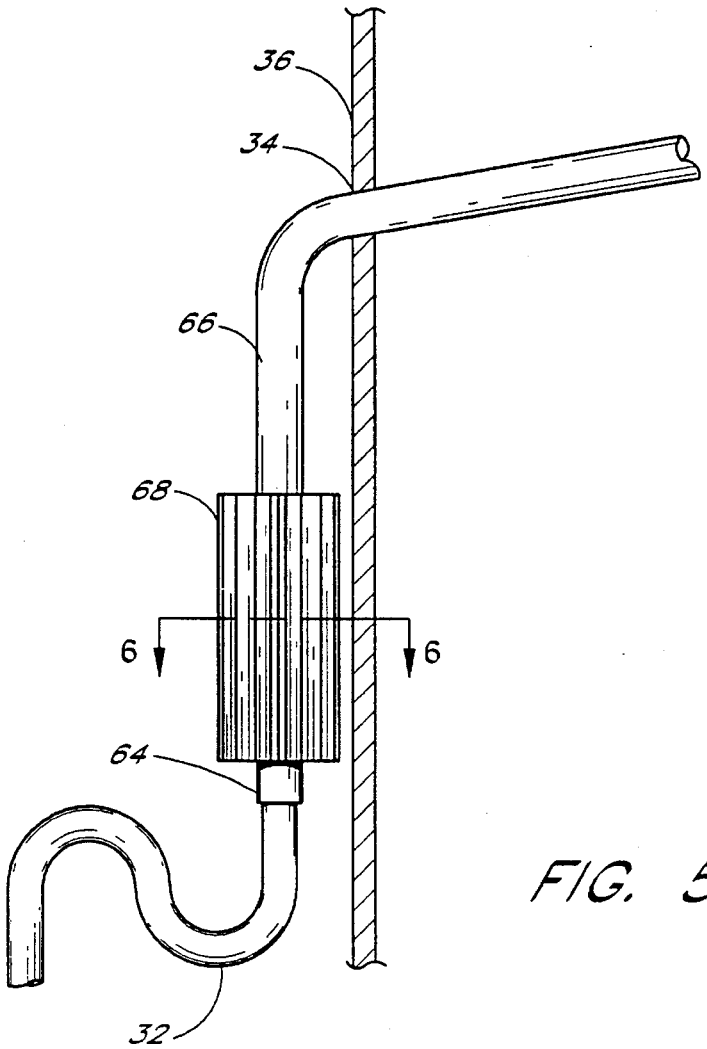
FIG. 5 is a schematic view of a fourth embodiment of the heat pipe defroster of the present invention, illustrating the use of a finned radiator portion to increase the surface area exposed to the warmer temperature.
Figure 6:
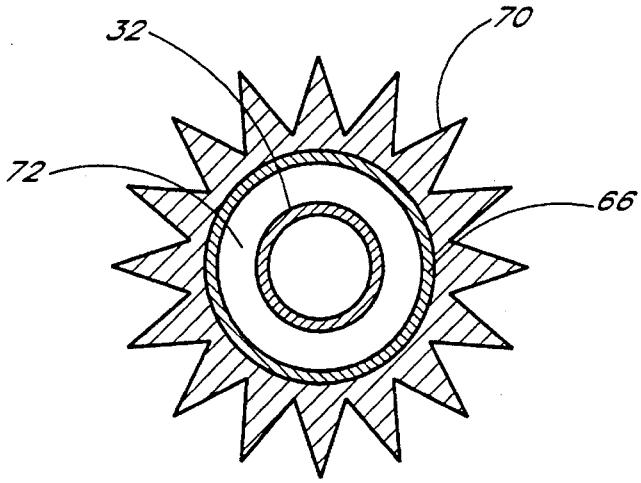
FIG. 6 is a cross-sectional view of the finned portion taken along lines 6—6 of FIG. 5.

Another variation of the embodiment of FIG. 3 is a preferred embodiment for increasing the surface area of an evaporator end 64 of a heat pipe 66, as illustrated in FIGS. 5 and 6. A finned portion 68 is formed along the evaporator end 64 such that fins 70 extend radially and axially, parallel to the axes of the drain line 32 and heat pipe 66. The finned portion 68 may contain the lowermost end of the heat pipe 66, or a small section of the evaporator end 64 of the heat pipe 66 may extend past the finned portion 68, as shown in FIG. 5. Preferably, the liquid portion of the heat transfer fluid is wholly contained in the finned portion 68, which is sized accordingly.

Referring to FIG. 6, it is clearly shown that the heat pipe 66 forms an annular space 72 around the drain line 32 through which the heat transfer fluid flows during the vaporization and condensation cycling. While the drain line 32 and heat pipe 66 are preferably fabricated from copper tubing, it is preferred that the fins 70 comprise an aluminum extrusion into which the copper heat pipe 66 is expanded in order to create a tight, interference fit. Any mechanical expansion process known to those of ordinary skill in the art may be utilized to achieve this fit. Thus, an increased efficiency in the heat transfer from the ambient air to the evaporator end 64 of the heat pipe 66, and therefore the drain line 32, is achieved. This efficiency is further promoted by vertical orientation of the finned portion 68 of the heat pipe 66, which aids natural convection along the lengths of the fins 70.

The embodiments illustrated and described above are provided as representative applications of the heat pipe passive defrost of the present invention utilized to prevent ice blockage of a drain line. Other changes and modifications may be made from the embodiments presented herein by those skilled in the art without departure from the spirit and scope of the invention, as defined by the appended claims.

What is claimed is:

1. A passive defroster for a drain of an evaporator for a refrigeration circuit, comprising:

a drain line connected to a drain tray positioned below the evaporator for removing condensation collected in the tray from the evaporator; and a sealed heat pipe containing a thermodynamic working fluid and having an evaporator end exposed to a heat source for heating of said working fluid to a vapor phase, and a condenser end positioned to warm said drain line to reduce or prevent buildup of frost and ice from blocking the drain line.

2. The passive defroster of claim 1, wherein said condenser end of said heat pipe is contained within said drain line.

3. The passive defroster of claim 1, wherein said condenser end of said heat pipe is coupled to the outside of said drain line.

4. The passive defroster of claim 3, wherein said heat pipe is a sleeve surrounding and spaced from said drain line to define a chamber between said drain line and said sleeve which is closed on its ends.

5. The passive defroster of claim 4, wherein said heat pipe includes a loop portion at said evaporator end to increase the capacity of said heat pipe to hold said working fluid and to increase the heat transfer surface of said heat pipe.

6. The passive defroster of claim 5, wherein said heat pipe includes a section surrounding said drain line, and a portion which does not surround said drain line but is in fluid communication with said section surrounding said drain line.

7. The passive defroster of claim 4, wherein said heat pipe includes a finned portion at said evaporator end to increase the heat transfer surface of said heat pipe.

8. The passive defroster of claim 7, wherein said finned portion comprises a plurality of vertically-oriented fins radiating from said heat pipe.

9. The passive defroster of claim 1, wherein said heat source is ambient air.

10. In a refrigeration system comprising:

an evaporator;

a drain below said evaporator for collecting condensation from said evaporator for removal; and a sealed heat pipe containing a heat transfer fluid and having an evaporator end exposed to ambient air for heating of said fluid to a vapor phase and a condenser end positioned to warm said drain to facilitate removal of condensation by reducing frost and ice buildup in said drain.

11. The refrigeration system of claim 10, wherein said condenser end of said heat pipe is contained within said drain.

12. The refrigeration system of claim 10, wherein said condenser end of said heat pipe is coupled to the outside of said drain.

13. A method of passively defrosting a drain from a drain pan located beneath an evaporator in a refrigeration circuit, comprising the steps of:

a) placing a condenser end of a sealed heat pipe in heat transfer relation with an inlet to said drain; and b) exposing an evaporator end of said heat pipe to a heat source such that a heat transfer fluid within said heat pipe is heated to a vapor phase.

14. The method of claim 13, wherein step b) comprises exposing said evaporator end to ambient air.

15. The method of claim 13, further including the step of extending said evaporator end of said heat pipe through a wall to an area having a temperature warmer than that of said drain inlet.

16. The method of claim 13, wherein step a) comprises positioning said condenser end on the outside of said drain.

17. The method of claim 13, wherein step a) comprises positioning said condenser end in the inside of said drain.

* * * * *